US006991529B2

(12) United States Patent
Annis et al.

(10) Patent No.: US 6,991,529 B2
(45) Date of Patent: Jan. 31, 2006

(54) HAND MANIPULATED TOOL

(75) Inventors: Kent V. Annis, Burnsville, MN (US); Karl W. Harlow, Rockford, MN (US)

(73) Assignee: Full Circle International, Inc, Burnsville, MN (US)

( * ) Notice: Subject to any disclaimer, the term of this patent is extended or adjusted under 35 U.S.C. 154(b) by 0 days.

(21) Appl. No.: 10/439,836

(22) Filed: May 16, 2003

(65) Prior Publication Data

US 2004/0229557 A1 Nov. 18, 2004

(51) Int. Cl.
*B23F 21/03* (2006.01)

(52) U.S. Cl. ..... 451/557; 451/28; 451/523; 451/524; 451/525; 451/344

(58) Field of Classification Search ..... 451/28, 451/523, 524, 525, 344
See application file for complete search history.

(56) References Cited

U.S. PATENT DOCUMENTS

| | | | | |
|---|---|---|---|---|
| 3,105,329 | A | 10/1963 | Sgorbati, Sr. | |
| 4,424,603 | A | 1/1984 | Balint et al. | |
| 4,625,462 | A | 12/1986 | Fushiya et al. | |
| 4,782,632 | A | 11/1988 | Matechuk | |
| 4,848,037 | A | 7/1989 | Happe | |
| 5,007,206 | A | 4/1991 | Paterson | |
| 5,056,268 | A * | 10/1991 | Wolff | 451/357 |
| 5,103,599 | A | 4/1992 | Carlson | |
| 5,239,783 | A | 8/1993 | Matechuk | |
| 5,313,746 | A * | 5/1994 | Zarriello | 451/522 |
| D353,313 | S | 12/1994 | Stiles | |
| D354,666 | S | 1/1995 | Kriebel | |
| 5,419,087 | A | 5/1995 | Haddy | |
| 5,527,212 | A | 6/1996 | Bowen et al. | |
| 5,545,080 | A | 8/1996 | Clowers et al. | |
| 5,690,545 | A | 11/1997 | Clowers et al. | |
| 5,791,977 | A | 8/1998 | Clowers et al. | |
| 5,885,145 | A | 3/1999 | O'Mara | |
| 5,947,803 | A * | 9/1999 | Gruner | 451/354 |
| 5,962,102 | A * | 10/1999 | Sheffield et al. | 428/92 |
| 6,053,805 | A * | 4/2000 | Sanchez | 451/456 |
| 6,095,911 | A | 8/2000 | Edens | |
| 6,109,811 | A | 8/2000 | Song | |
| 6,227,959 | B1 | 5/2001 | Beaudry | |
| 6,325,708 | B1 | 12/2001 | Miles | |
| 6,361,424 | B1 * | 3/2002 | Manor et al. | 451/490 |
| 6,406,365 | B1 | 6/2002 | Ueno | |
| 6,468,141 | B1 | 10/2002 | Conboy et al. | |
| 6,500,057 | B1 | 12/2002 | Medina | |
| 6,523,214 | B1 * | 2/2003 | Kaiser | 15/230 |
| 6,524,175 | B2 | 2/2003 | Beaudry et al. | |
| 6,634,937 | B1 * | 10/2003 | Edwards et al. | 451/502 |
| 6,659,852 | B1 * | 12/2003 | Wettstein et al. | 451/557 |

FOREIGN PATENT DOCUMENTS

| | | |
|---|---|---|
| DE | 3105426 | 8/1982 |
| GB | 846413 | 8/1960 |
| GB | 1238006 | 7/1971 |
| GB | 2298379 | 9/1996 |
| GB | 2299038 | 9/1996 |

* cited by examiner

*Primary Examiner*—Lee D. Wilson
*Assistant Examiner*—Shantese McDonald
(74) *Attorney, Agent, or Firm*—Brooks & Cameron, PLLC

(57) ABSTRACT

An embodiment of a hand manipulated tool includes an elongate handle and a tool support. The tool support has a center, rotationally fixed to the elongate handle. The tool support has a periphery with at least five points equidistant from the center.

20 Claims, 5 Drawing Sheets

HAND MANIPULATED TOOL

INTRODUCTION

Hand held tools have been utilized in many fields for working the surface of a material, such as sanding, polishing, and painting, among others. For example, when fabricating a structure, such as a wall or ceiling in a building, oftentimes it is necessary to utilize a sanding device to smooth the surface of the structure. In response to this need, in the field of sanding devices for example, devices have been proposed.

One device utilizes a sanding head having an elongate rectangular head. This head is designed to accommodate a standard sized elongate sheet of sand paper, thereby making the supply of sanding paper readily accessible. However, when the device is manipulated, due to its narrow configuration, the device tends to flip onto its elongate sides and can damage the surface of the wall, for example by gouging the surface with the corners or edges of the device, requiring filling or additional sanding to remove the damage.

A device has also been proposed to aid in sanding corners that utilizes an acute isosceles triangular shape. However, since the isosceles triangle has a tall narrow profile, this device also has a narrow region near the attachment to the handle and encounters the same flipping problem.

Additionally, the angles do not match that of most corners on surfaces and therefore, a corner of the device needs to be moved around the area of the corner of the surface in order to completely work such an area. This approach can lead to uneven sanding and increases the risk of poking the corner of the device into one of the adjacent walls forming the corner.

Another device utilizes a motorized rotating head that rotates rapidly to reduce the number of passes the device must take over an area. These devices are larger and more cumbersome due to the mechanical motor assembly and have a circular, non-continuous "O" shaped working surface due to the need to have access to a bolt. The bolt is seated in the center of the "O" defined by the working surface. The bolt is used to remove it from the rotational axis of the device in order to remove the sanding or other type of working material mounted to the head. This device takes a greater level of skill to master and if used improperly, can damage the surface by dishing to create swirl marks in the surface.

DETAILED DESCRIPTION

Embodiments of the present invention provide working devices that reduce the potential for tipping of a head of the device on its side.

As one of ordinary skill in the art will appreciate upon reading this disclosure, a working device can be utilized in many fields depending upon what working material is utilized.

Figure 1:
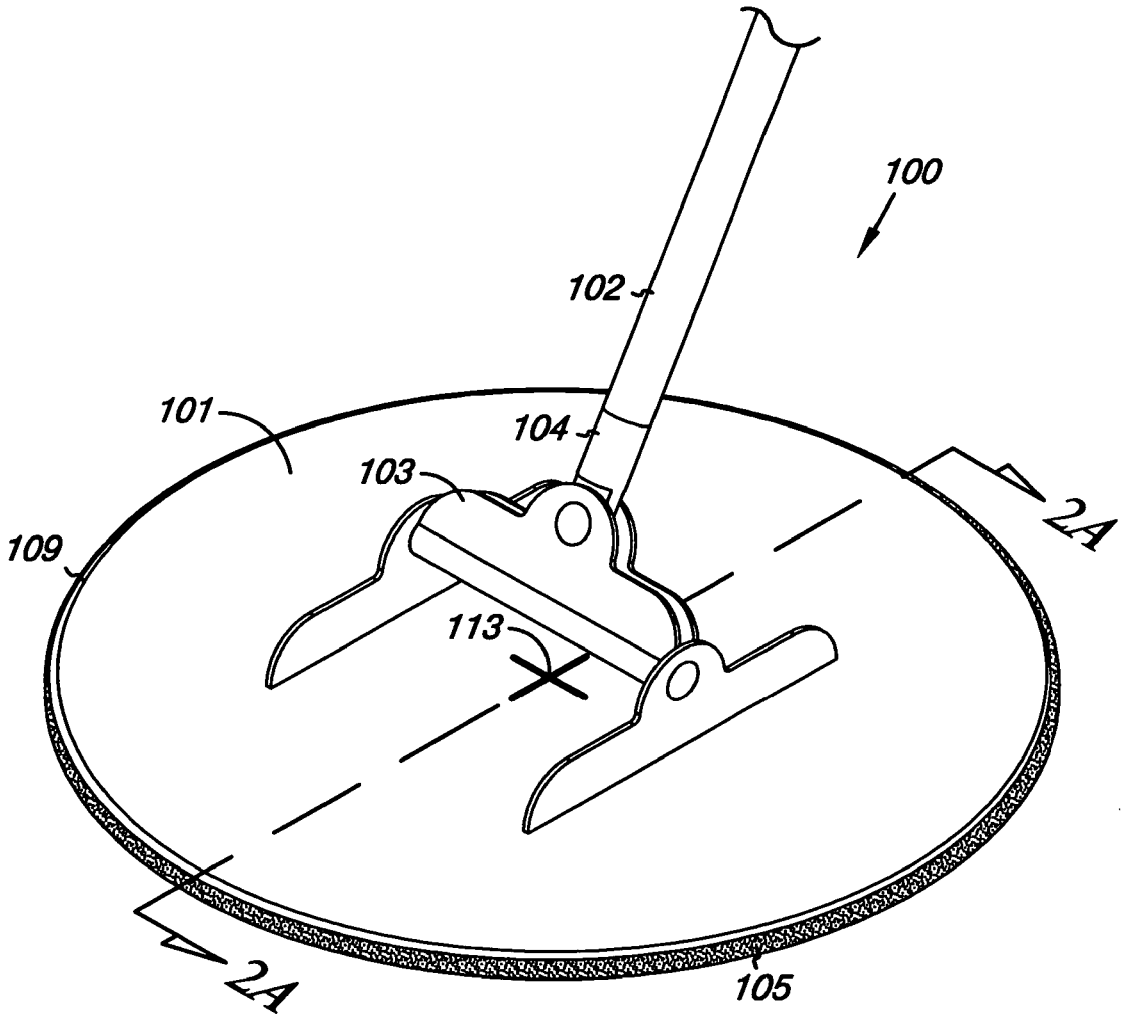
FIG. 1 illustrates a top perspective view of an embodiment of a device head attached to a handle.

FIG. 1 illustrates a top perspective view of an embodiment of a device head 100 attached to a handle 102. In this embodiment, the handle 102 is an elongate handle, such as a broom handle, dowel, or extended pole, however, the invention is not so limited.

In FIG. 1, the device head 100 includes a tool support 101 that can be attached to the handle 102 in any manner. For example, as shown in FIG. 1, the tool support 101 can be attached to the handle 102 by a pivoting structure. In the example shown, a two piece, two directional structure is provided. In this example, a first piece 103 having a first pivoting point is connected to a second piece 104 also having a pivot point. The first piece 103 allows the handle 102 to pivot radially with respect to the attachment point of the handle 102 to the tool support 101.

In this embodiment, the second piece 104 allows the handle 102 to pivot radially with respect to the attachment point of the handle 102 to the tool support 101, but generally perpendicular to the pivotal movement provided by the first piece 103. The use of the two pieces 103 and 104 allows for the handle 102 to achieve many positions with respect to the tool support 101, however, the invention is not limited to the use of the two pivotable attachment pieces shown. For example, a ball joint or other universal joint type structure can be utilized. In some embodiments, the handle 102 can be fixed with respect to the tool support 101.

In the embodiment shown in FIG. 1, the tool support 101 has a pad 105 attached to the lower surface of the support 101. The pad 105 can be a rigid, i.e. inflexible, or resilient material. In an embodiment, where the pad 105 is a resilient material it can be utilized, for example, to cushion the force of the support 101 on the surface being worked on. In an embodiment where the pad 105 is an inflexible material, it can be utilized to distribute force more directly to the surface being worked on.

The pad 105 can be fabricated from a working material or can have a working material attached thereto. A working material can be any type of material that can be utilized to perform work on a surface. Some examples of working materials include, but are not limited to abrasive materials such as sand paper, materials for the application of paint or stain, and materials for polishing, among others. The attachment of the pad 105 to the support 101 can be accomplished in any manner.

As shown in FIG. 1, the support 101 has a periphery 109 defined by its outside edge and the periphery 109 has many points that are equidistant from the center 113 of the support 101. In some embodiments, the handle 102 is attached such that it is centered on the surface of the support 101.

Figure 2A:
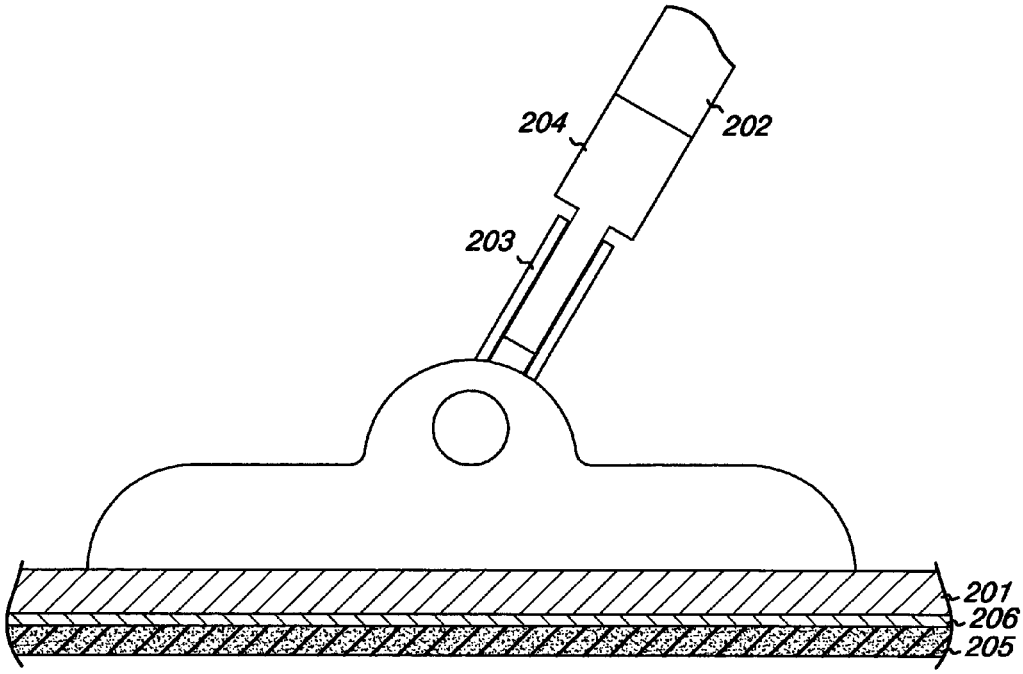
FIG. 2A illustrates a side view of the embodiment of FIG. 1.

For example, FIG. 2A illustrates a side view of the embodiment of FIG. 1. FIG. 2A illustrates a support 201 having an attachment layer 206 connected thereto. In various embodiments, the attachment layer is, for example, hook and loop fasteners that can be utilized to releasably attach one or more of the layers of the device head, e.g. support 201 and pad 205, to one another. The attachment layer can include a number of fastening mechanisms including but not limited to, glues, epoxies, and other mechanical attachment structures, to name a few.

Figure 2B:
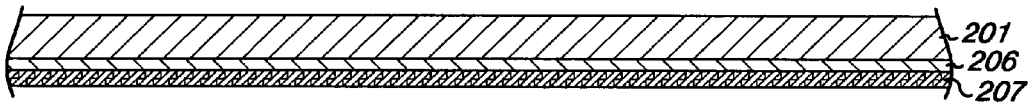
FIG. 2B illustrates a side view of another embodiment of a device head.

FIG. 2B illustrates a side view of another embodiment of a device head. The embodiment illustrated in FIG. 2B includes a support 101, a working material 207, and an attachment layer 206 that attaches the support 201 to the working material 207. In this embodiment, the device can have a low profile and can distribute force more directly to the material 207.

In FIG. 2B, the working material is shown as an abrasive material, such as sand paper. The working material can be any material suitable for conditioning a surface. Such materials include, but are not limited to abrasives, polishers, and liquid applicators for the application of paints, stains, and the like.

Figure 2C:
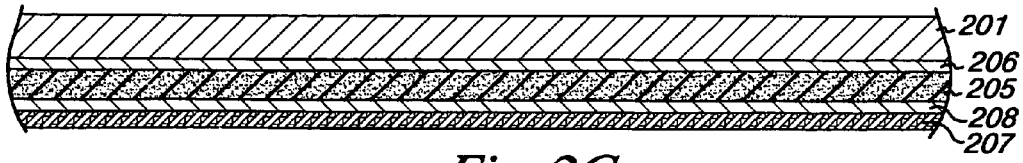
FIG. 2C illustrates a side view of another embodiment of a device head.

FIG. 2C illustrates a side view of another embodiment of a device head. The embodiment illustrated in FIG. 2C includes a support 201, a pad 205, an attachment layer 206 that attaches the support 201 to the pad 205, a working material 207, and an attachment layer 208 that attaches the working material 207 to the pad 205. In this embodiment, the pad 205 can be utilized, for example, to cushion the force of the support 201 to the working material 207. Those skilled in the art will understand that the pad 205 can have a working material formed on the pad, or that the pad can be constructed of a working material, and therefore there would be no need for an attachment layer to be utilized between the pad and the working material.

FIG. 2C illustrates the use of an attachment layer 206, such as for example hook and loop fasteners, that can be utilized to releasably attach the working material 207 to the support 201. FIG. 2C also illustrates the use of a working material 207 attached to the lower surface of the pad 205 by an attachment layer 208. Those skilled in the art will understand that any fastening mechanisms can be utilized for the attachment of any of the layers, such as support 201, pad 205, attachment layers 206 and 208, working material 207, and the like, to one another.

Those skilled in the art will understand that embodiments utilizing one or more releasable fastening mechanisms can rapidly change the types of working materials that can be utilized and can add pads to the device without having to remove the handle from the head of the device and attach a new head to the handle.

Figure 3:
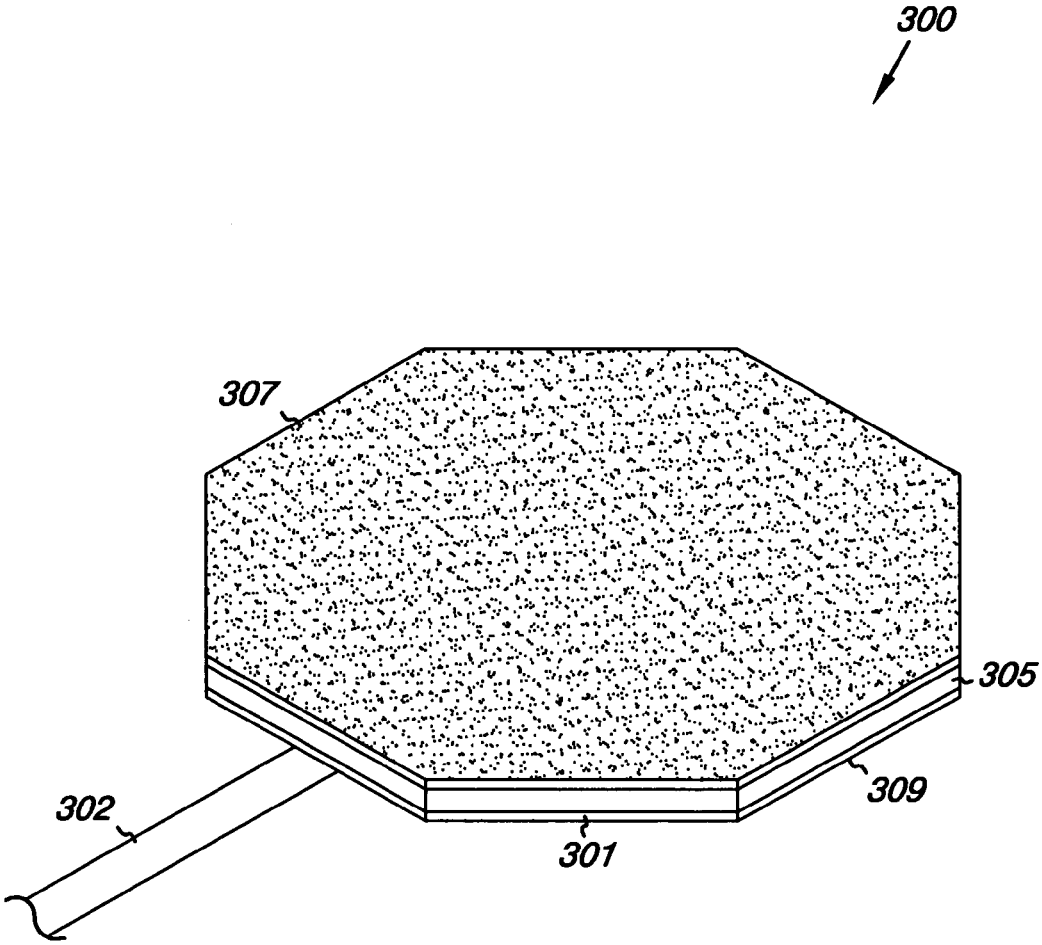
FIG. 3 illustrates a bottom perspective view of another embodiment of a device head attached to a handle.

FIG. 3 illustrates a bottom view of another embodiment of a device head 300 attached to a handle 302. The embodiment shown in FIG. 3 includes a tool support 301, a handle 302, a pad 305 and a working material 307. In this embodiment, the periphery 309 of the support 301 has a polygonal shape.

In this embodiment, the periphery 309 has eight sides. This embodiment also includes at least five points on the periphery 309 that are equidistant from the center of the tool support 301. In this manner the head 300 is resistant to tipping. In this embodiment, the support 301 is an equilateral polygon. The polygon has at least four intersecting edges that are equidistant from the center of the support 301. Those skilled in the art will understand that the support 301 can have any number of sides or can be circular in shape. For example, in one embodiment, the tool support can have at least 4 intersecting edges equidistant from a center of the support.

The device includes a handle 302 attached to tool support 301. The tool support 301 has a pad 305 attached thereto. The pad 305 can be constructed from a working material or, as shown in FIG. 3, can have a working material 307 attached to the pad 305.

Figure 4:
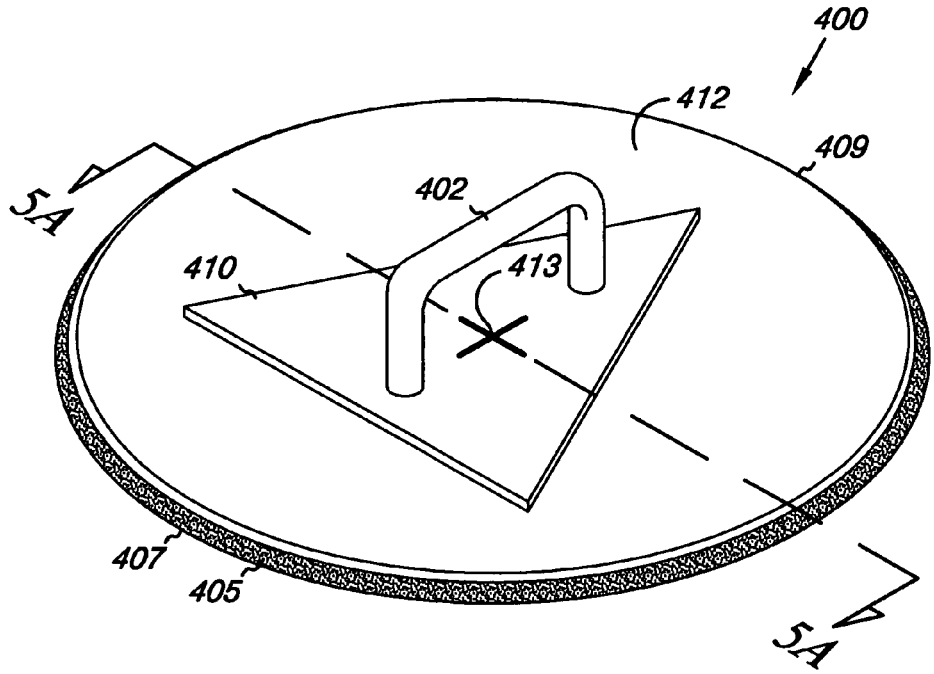
FIG. 4 illustrates a top perspective view of an embodiment of a device head attached to a handle.

FIG. 4 illustrates a top perspective view of an embodiment of a device head 400, such as described above, attached to a handle 402. The device head 400 includes a body that is separable into at least two parts. For example, in the embodiment shown in FIG. 4, the body includes a first tool support 410 having a handle 402. In the embodiment shown in FIG. 4, the handle 402 is a grasping handle, however the invention is not so limited. A grasping handle 402 as shown in FIG. 4, is a handle proximal to the head 400 that can be grasped by a user's hand.

The support 410 is releasably attached to a second tool support 412. In this way, a user can utilize the second tool support 412, for example, for sanding a broad area of a surface, such as a wall. The user can then remove the second tool support 412 and utilize the first tool support 410, for example, to sand the corners or edges of the surface by attaching a working surface to the first tool support 410.

If the second tool support 412 is needed again, the second tool support can be reattached to the first tool support 410. Those skilled in the art will understand from reading this disclosure that the first and second tool supports do not need to be directly attached, but rather, can have one or more layers, such as pads and attachment layers, among others, between them as the same have been described herein. In this manner, the embodiment of the device shown in FIG. 4 allows for a first and second head to be rapidly deployed and can allow for a user to change tools without having to remove the handle from the head of the device and attach a new head to the handle.

As shown in FIG. 4, this embodiment includes a circular second tool support 412 that has points on a periphery 409 equidistant from the center 413 of the support 412. This enables the device to maintain its stability and reduce the tendency of the device to flip onto its side. Additionally, embodiments utilizing a uniformly increased distance of the device's outside edges from the center of the device benefit from a reduced ability of the device to flip, e. g. obviates any proclivity of the device to upset or flip in a direction of motion.

Figure 5A:
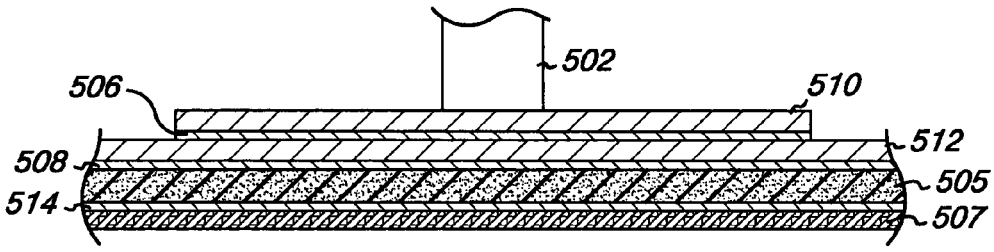
FIG. 5A illustrates a side view of the embodiment of FIG. 4.

FIG. 5A illustrates a side view of the embodiment of FIG. 4. The embodiment illustrated in FIG. 5A includes a first tool support 510, an attachment layer 506 that attaches the first tool support 510 to a second tool support 512, a pad 505, an attachment layer 508 that attaches the second tool support 512 to the pad 505, and an attachment layer 514 that attaches the pad 505 to a working material 507. In this manner, the pad 505 can be utilized, for example, to cushion the force of the second support 512 to the working material 507.

Those skilled in the art will understand that one type, or several different types of an attachment layers can be utilized to attach one or more of the layers of the head of the device, e.g. tool supports, working materials, pads, and the like. For example, those skilled in the art will understand that one or more of the attachment layers 506, 508, and 514 can be releasably attached to allow for removal of one or more layers of the head and attachment of other layers.

Figure 5B:
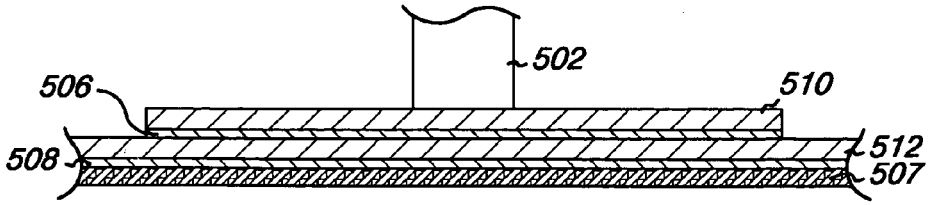
FIG. 5B illustrates a side view of another embodiment of a device head.

FIG. 5B illustrates a side view of another embodiment of a device head. The embodiment illustrated in FIG. 5B includes a first tool support 510 an attachment layer 506, a second tool support 512, a working material 507, and an attachment layer 508 that attaches the second tool support 512 to the working material 507.

FIG. 5B illustrates the use of attachment layers 506 and 508, such as for example hook and loop fasteners, that can be utilized to releasably attach the first tool support 510 to the second tool support 512.

FIG. 5B also illustrates the use of a working material 507 attached to the second support 512 by an attachment layer 506. In this manner, the device can have a low profile and the second support 512 can distribute force directly to the material 507.

Figure 6A:
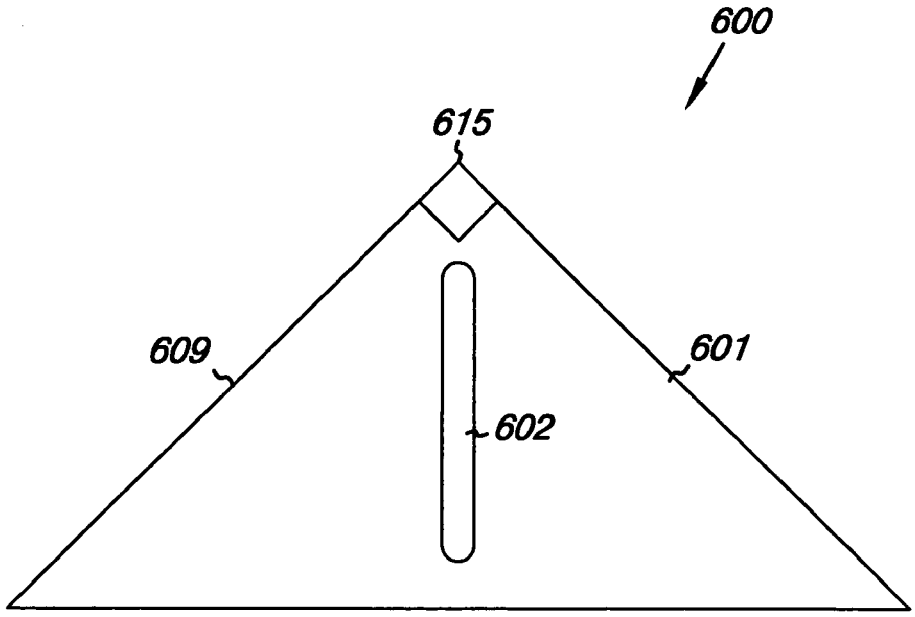
FIG. 6A illustrates a top view of another embodiment of a device head attached to a handle.

FIG. 6A illustrates a top view of another embodiment of a device head 600 attached to a handle 602 as described above. In FIG. 6A, the embodiment includes a support 601 and a handle 602. The support 601 includes a right angle 615 defined by the periphery 609 of the support 601. In this embodiment, the right angle 615 provides a surface that is configured to work in right angle corners. This is particularly useful in working on surfaces in building such as floors, ceilings, and walls where most surfaces are at right angles to adjacent surfaces. Further, by having an angle that is 90 degrees or greater creates a wider triangle and the wide sides of the triangle act to reduce the tendency of the device to flip onto its sides. In one embodiment, the handle 602 is oriented such that a length of the handle 602 is perpendicular to a hypotenuse side of the support 601, as shown in FIG. 6A.

Figure 6B:
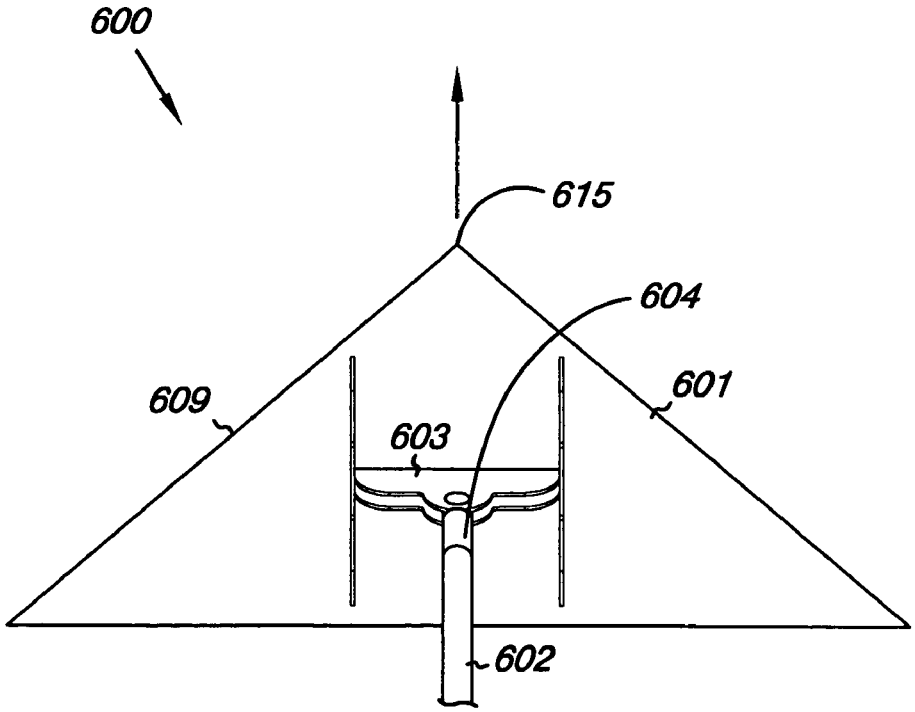
FIG. 6B illustrates a top view of another embodiment of a device head attached to a handle.

FIG. 6B illustrates a top view of another embodiment of a device head attached to a handle. In FIG. 6B the embodiment includes, a support 601 and a handle 602. The support 601 includes an obtuse angle 615 defined by the periphery 609 of the support 601. By having an angle that is 90 degrees or greater it creates a wider triangle and the wide sides of the triangle act to reduce the tendency of the device to flip onto its sides.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention. It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature of the technical disclosure. It is submitted with the understanding that it will not be used to limit the scope of the claims.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The invention claimed is:

1. A non-motorized hand manipulated tool, comprising:

a rigid tool support, having a center, the tool support having a periphery with at least five points equidistant from the center;

wherein the hand manipulated tool further includes a replaceably attached pad and a working material replaceably attached to the pad; and wherein the periphery of the rigid tool support is substantially the same size as a periphery of at least one of the pad and working material.

2. The tool of claim 1, wherein the tool support includes a tool support that is pivotally connected to an elongate handle and the at least five points equidistant from the center are operable to prevent flipping of the tool support about the pivotal connection.

3. The tool of claim 1, wherein the periphery of the tool support is circular.

4. The tool of claim 1, wherein the periphery of the tool support is a polygon.

5. The tool of claim 4, wherein the periphery of the tool support is hexagonal.

6. The tool of claim 1, wherein the pad is sized having the periphery at least as large as the periphery of the tool support.

7. The tool of claim 1, wherein the pad has a continuous surface bounded by the periphery of the pad.

8. A tool head, comprising:

a body separable into at least two parts, including;

a first tool support having a center and a lower engagement surface, said lower engagement surface configured for attachment of a working material thereto when the second tool support is released from the first tool support; and a second tool support releasably attached to the lower engagement surface of the first tool support.

9. The tool head of claim 8, wherein the tool head is configured for attachment of the first tool support to an elongate handle.

10. The tool head of claim 8, wherein the tool head is configured for attachment of the first tool support to a grasping handle.

11. The tool head of claim 8, wherein the second tool support includes a second tool support configured for attachment of a working material thereto.

12. The tool head of claim 11, wherein the working material includes a sanding material.

13. The tool head of claim 11, wherein the working material includes a polishing material.

14. The tool head of claim 8, wherein the attachment of the second tool support to the first tool support includes a resilient layer interposed between the first and second tool supports.

15. The tool head of claim 8, wherein the attachment of the second tool support to the first tool support includes an inflexible layer interposed between the first and second tool supports.

16. A hand manipulated tool, comprising:

an elongate handle; and a rigid tool support, the tool support having a periphery; and a resilient pad, replaceably attached to the tool support via a hook and loop fastening structure, and a working material replaceably attached to the pad.

17. The tool of claim 16, wherein the periphery forms an interior angle that is an obtuse angle and the periphery is operable to prevent flipping of the tool support about the pivotal connection.

18. A method, comprising:

applying a non-motorized hand manipulated tool to a working surface wherein the hand manipulated tool includes an elongate handle and a rigid tool support, having a center, the tool support having a periphery with at least five points equidistant from the center and having a pad, replaceably attached to the tool support, and a working material, replaceably attached to the pad, and wherein the periphery of the tool support is substantially the same size as a periphery of at least one of the pad and working surface; and advancing the hand manipulated tool in one or more directions across the working surface.

19. A tool head, comprising:

a body separable into at least two parts, including;

a first tool support having a center and a lower engagement surface;

a second tool support releasably attached to the lower engagement surface of the first tool support; and wherein the attachment of the second tool support to the first tool support includes a resilient layer interposed between the first and second tool supports.

20. A tool head, comprising:

a body separable into at least two parts, including;

a first tool support having a center and a lower engagement surface;

a second tool support releasably attached to the lower engagement surface of the first tool support; and wherein the attachment of the second tool support to the first tool support includes an inflexible layer interposed between the first and second tool supports.

* * * * *

UNITED STATES PATENT AND TRADEMARK OFFICE

CERTIFICATE OF CORRECTION

PATENT NO. : 6,991,529 B2 
DATED : January 31, 2006
INVENTOR(S) : Kent V. Annis and Karl W. Harlow It is certified that error appears in the above-identified patent and that said Letters Patent is hereby corrected as shown below:

Column 8,
Line 19, add:
-- 21. A non-motorized hand manipulated tool, comprising:
a rigid tool support, having a center, the tool support having a hexagonal periphery with at least five points equidistant from the center; and
wherein the hand manipulated tool further includes a replaceably attached pad and a working material replaceably attached to the pad.
22. A non-motorized hand manipulated tool, comprising:
an elongate handle;
a rigid tool support, the tool support having a periphery that is an equilateral pentagon; and
wherein the hand manipulated tool further includes a replaceably attached pad and a working material replaceably attached to the pad. --.

Signed and Sealed this

Fourth Day of April, 2006

JON W. DUDAS
*Director of the United States Patent and Trademark Office*